US005179819A

United States Patent [19]

Sukeyasu et al.

[11] Patent Number: 5,179,819

[45] Date of Patent: Jan. 19, 1993

[54] METHODS OF PREPARATION OF PACKAGING BAGS FOR BOTTLES, METHODS OF PREPARATION OF PACKAGING BOTTLES AND APPARATUS UTILIZED THEREFOR

[75] Inventors: Ryuzo Sukeyasu, Tokyo; Yoshiyuki Kishina, Yamato; Masao Okawa, Niihama; Naoyuki Horigome, Niihama; Yasuhito Ito, Niihama, all of Japan

[73] Assignees: Sumitomo Bakelite Company, Ltd.; Sumitomo Heavy Industries, Ltd., both of Tokyo, Japan

[21] Appl. No.: 729,936

[22] Filed: Jul. 15, 1991

[30] Foreign Application Priority Data

Jul. 20, 1990 [JP] Japan ..... 2-192434
Jul. 20, 1990 [JP] Japan ..... 2-192435
Aug. 10, 1990 [JP] Japan ..... 2-213440

[51] Int. Cl.[5] ..... B65B 9/14; B65B 53/02

[52] U.S. Cl. ..... 53/442; 53/386.1; 53/456; 53/557; 53/567

[58] Field of Search ..... 53/442, 557, 556, 441, 53/509, 456, 567, 258, 255, 386.1

[56] References Cited

U.S. PATENT DOCUMENTS 2,800,163 7/1957 Rusch ..... 154/42
3,053,723 9/1962 Plach et al. ..... 53/567 X
3,557,526 1/1971 Hartmann ..... 53/567
3,558,406 1/1971 Kugler ..... 156/515
3,579,948 5/1971 Lerner ..... 53/386.1 X
4,553,376 11/1985 Okada et al. ..... 53/567 X
4,730,437 3/1988 Benno ..... 53/567 X
4,765,121 8/1988 Konstantin et al. ..... 53/567 X

*Primary Examiner*—James F. Coan
*Attorney, Agent, or Firm*—Frishauf, Holtz, Goodman & Woodward

[57] ABSTRACT

A method of preparation of packaging bags for bottles, wherein a scrap piece formed at the closed end of the bag is discharged by mechanical methods. In one method, a long cylindrical film sheet is fed to the apparatus so as to place the portion of the film sheet forming the open end of the bag at the top and both sides of scrap pieces are cut and separated simultaneously. In another method, a long cylindrical film sheet is fed to the apparatus so as to place the portion of the film sheet forming a scrap piece at the top, and the scrap piece and the periphery of a closed end of the bag are cut simultaneously. In the method of packaging bottles, fitting of the packaging bag to the bottle is performed smoothly and automatically by widely opening the open end of the packaging bag by utilizing vacuum pads, inserting the bottle with a rod into the open end of the bag by utilizing a flapper, allowing partial heat shrinking of the bag for temporary fitting of the bag to the bottle and then tightly fitting the bag to the bottle by heating. By the above techniques, the operations are carried out continuously by using a long film sheet with good efficiency, reduced labor and good quality.

30 Claims, 7 Drawing Sheets

METHODS OF PREPARATION OF PACKAGING BAGS FOR BOTTLES, METHODS OF PREPARATION OF PACKAGING BOTTLES AND APPARATUS UTILIZED THEREFOR

BACKGROUND OF THE INVENTION

1. Field of the Invention

The present invention relates to novel methods of preparation of packaging bags for bottle by utilizing heat shrinking film, novel methods of preparation of packaging bottles and novel apparatus utilized therefore.

More particularly, the present invention relates to methods of continuous preparation of packaging bags for bottles made of heat shrinking film sheet which is fitted over the top of a bottle having a narrow opening at the top and allowed to heat shrink by heating to make a packaging bottle fitted tightly in the shape of the bottle with the packaging bag by the shrinking force of the bag and an apparatus utilized therefor. The present invention also relates to methods of preparation of packaging bottles which comprise fitting a packaging bag made of heat shrinking film sheet over the top of a bottle having a narrow opening at the top and heat shrinking the packaging bag by heating to make a packaging bottle fitted tightly in the shape of the bottle with the packaging bag by the action of the shrinking force of the bag and an apparatus utilized therefor.

2. Description of the Prior Art

Packaging of bottles by utilizing heat shrinking film has been widely practiced.

Packaging bottles having heat shrinking film can be prepared by fitting a bag made of film formed by closing an end of cylindrical film by heat sealing, such as shown in FIG. 9, over a bottle and then by heat shrinking by heating to make a tightly fitted film over the outside of the bottle in the shape of the bottle.

The closed end of the packaging bag is made into a shape of arch as shown in FIG. 9 to make the packaging film fit tightly in the shape of the cap of the bottle after heat shrinking. If the closed end of the packaging bag has a shape of straight line, the film sheet at the corners of the closed end do not fit tightly to the shape of the cap of the bottle but remain separated from the face of the bottle.

The packaging bag having the closed end of arch shape as shown in FIG. 9 shrinks to the same shape as the bottle. The cap of the bottle is fixed by the shrinking action of the packaging bag and this condition makes so called virgin seal. When the face of the film sheet is printed with marks and labels, the marks and labels are easily placed on the face of the packaging bottle even when printing is not possible on the bare face of the bottle.

Packaging bottles fitted with heat shrinking film are generally prepared by the following method: a number of packaging bags attached with a scrap piece S to each of the bags are prepared by heat sealing the closing end T of the packaging bags in a shape of arch as shown in FIG. 10; after the packaging bags thus prepared are stacked, scrap pieces S are discharged manually; the remaining packaging bags R as shown in FIG. 9 are stored once in a bag supply box of a packaging machine in the form of stacked bags; the packaging bag is taken out one by one to a packaging table and placed over the outside of a bottle; and then the packaging bag is allowed to shrink by heating to prepare a packaging bottle fitted with the bag.

The conventional method described above has problems that efficiency of the operation is low because manual operations are included during the process and also because blocking and letting air out of a bag are not easily made and that the number of deficient packaging, such as misplaced printing and uneven shrinking of the film, is increased because the packaging bag makes erroneous movement from the correct position during shrinking.

The conventional method described above has another problem that automatic continuous fitting of the packaging bag to the bottle cannot be smoothly operated in spite of numerous trials for the purpose. This problem arises because the diameter of the packaging bag cannot be made much larger than the diameter of the bottle to achieve good fitting of the film to the bottle by heat shrinking.

SUMMARY OF THE INVENTION

The present invention accordingly has an object to provide methods of preparation of packaging bags for bottles made of heat shrinking film continuously with elimination of labor and with good efficiency from a long film sheet by solving the problems of the conventional method of preparation. Another object of the present invention is to provide apparatus utilized therefore.

Still another object of the invention is to provide methods of preparation of packaging bottles with elimination of labor and with good efficiency from a film sheet by solving the problems of the conventional method of preparation. Still another object of the present invention is to provide apparatus utilized therefore.

It was discovered by the present inventors that major cause of the problem in the generally practiced methods that preparation of packaging bags can not be performed continuously is that the scrap piece S shown in FIG. 10 produced in the cutting process of the preparation of packaging bags can not be discharged by mechanical methods and manual operations are required.

It was also discovered by the present inventors that the scrap piece S can be easily handled and smoothly discharged to the outside of the preparation process when the long cylindrical film sheet is fed to the apparatus so as to place the portion of the film sheet which is to form the open end of the packaging bag at the top, the both ends of the scrap piece shown by a straight line A and a curved line B in FIG. 5 are cut off approximately simultaneously and the scrap pieces are removed from the both ends of the film sheet approximately simultaneously.

It was also discovered by the present inventors that, when the long cylindrical film sheet is fed to the apparatus so as to place the portion of the film sheet which is to form the scrap pieces at the top, the scrap piece S can be removed from the end of the film sheet by cutting only the straight line portion A of FIG. 6. It was also discovered that the preparation of the packaging bag is performed efficiently by cutting the scrap piece S and the peripheral part of the closed end of the packaging bag approximately simultaneously.

It was also discovered that the fitting of the packaging bag to the bottle is performed smoothly and automatically by utilizing a flapper for the fitting operation.

The invention was completed on the basis of the above discoveries.

Thus, the present invention comprises following inventions:

1. A method of preparation of packaging bags for bottles which is characterized in that the packaging bags are continuously prepared by (A) feeding an end part of a long cylindrical film sheet made of heat shrinking film as the material intermittently by the length of a cutting unit along a cutting and heat sealing table and then fixing the end of the long cylindrical film sheet at a definite position on the cutting and heat sealing table; (B) cutting off a packaging bag and a scrap piece approximately simultaneously from the end of the long cylindrical film sheet by means of a heat sealing blade of arch shape which heat seals the closing end of the packaging bag at a position within the length of the cutting unit from the end of the long cylindrical film sheet, a cutting blade of arch shape or a cutting blade of straight shape which cuts the long cylindrical film sheet at the periphery of the heat sealed part and a cutting blade of straight shape which is fixed at a position separated from the heat sealing blade of arch shape and used for cutting the open end of the packaging bag; and (C) discharging the scrap piece from the cutting and heat sealing table by a mechanical method.

2. An apparatus for continuous preparation of packaging bags for bottles which comprises: (A) means of intermittently feeding an end part of a long cylindrical film sheet made of heat shrinking film as the material by the length of a cutting unit along a cutting and heat sealing table; and (B) means of cutting and heat sealing comprising means of fixing the end part of the long cylindrical film sheet intermittently to the cutting and heat sealing table in a synchronized action with the intermittent feeding of the long cylindrical film sheet; a heat sealing blade of arch shape which heat seals the closing end of the packaging bag at a position within the length of the cutting unit from the end of the long cylindrical film sheet, a cutting blade of arch shape or a cutting blade of straight shape which cuts the long cylindrical film sheet at the periphery of the heat sealed part and a cutting blade of straight shape which cuts the open end of the packaging bag; means of cutting off the packaging bag and a scrap piece approximately simultaneously from the end of the long cylindrical film sheet and heat sealing the closed end of arch shape of the bag by reciprocal sliding movement of the heat sealing blade of arch shape and the cutting blade of straight shape in a synchronized action with the intermittent fixing of the long cylindrical film sheet to the cutting and heat sealing table; and means of discharging the scrap piece formed by the cutting from the cutting and heat sealing table.

3. A method of continuous preparation of packaging bottles which comprises:

(A) the first process which automatically prepares a packaging bag by (a) feeding an end part of a long cylindrical film sheet made of heat shrinking film as the material intermittently by the length of a cutting unit along a cutting and heat sealing table and then fixing the end of the long cylindrical film sheet at a definite position on the table; (b) cutting off a packaging bag and a scrap piece approximately simultaneously from the end of the long cylindrical film sheet by means of a heat sealing blade of arch shape which heat seals the closing end of the packaging bag at a position within the length of the cutting unit from the end of the long cylindrical film sheet and cuts the long cylindrical film sheet at the outer periphery of the heat sealed part and a cutting blade of straight shape which is fixed at a position separated from the heat sealing blade of arch shape and used for cutting the open end of the packaging bag; and (c) discharging the scrap piece from the cutting and heat sealing table by a mechanical method;

(B) the second process in which the open end of the packaging bag prepared in the first process is made widely open and a bottle is covered with the packaging bag at the outside of the bottle by inserting into the open end of the packaging bag; and (C) the third process in which the bottle and the packaging bag fitted at the outside of the bottle are heated and the packaging bag is allowed to shrink to prepare a packaging bottle tightly fitted with the packaging bag at the outside.

4. An apparatus for continuous preparation of packaging bottles which comprises:

(A) means of intermittently feeding an end part of a long cylindrical film sheet made of heat shrinking film as the material by the length of a cutting unit along a cutting and heat sealing table;

(B) means of cutting and heat sealing comprising means of fixing the end part of the long cylindrical film sheet intermittently to the cutting and heat sealing table in a synchronized action with the intermittent feeding of the long cylindrical film sheet; a heat sealing blade of arch shape which heat seals the closing end of the packaging bag at a position within the length of the cutting unit from the end of the long cylindrical film sheet; a cutting blade of arch shape or a heat sealing blade of arch shape which cuts the long cylindrical film sheet at the periphery of the heat sealed part; a cutting blade of straight shape which cuts the open end of the packaging bag; means of cutting off the packaging bag and a scrap piece approximately simultaneously from the end of the long cylindrical film sheet by reciprocal sliding movement of the heat sealing blade of arch shape and the cutting blade of straight shape in a synchronized action with the intermittent fixing of the long cylindrical film sheet to the cutting and heat sealing table; and means of discharging the scrap piece formed by the cutting from the cutting and heat sealing table;

(C) means comprising a device for making the open end of the packaging bag formed at the cut position widely open by holding the outside of the packaging bag by the action of vacuum pads; and means of inserting a bottle into the open end of the packaging bag in a synchronized action with the action of making the open end of the packaging bag widely open; and (D) means of heat shrinking the packaging bag fitted to the bottle by heating.

5. A method of preparation of packaging bottles which comprises:

(A) a process in which the open end of a packaging bag prepared by closing an end of a cylindrical film sheet made of heat shrinking film as the material by melting in an arch shape and leaving the other end of the cylindrical film sheet open is made widely open by pulling from the outside of the cylindrical film sheet by the action of vacuum pads attached to the outside of the cylindrical film sheet, followed by separating the vacuum pads from each other; a flapper is inserted into the open end of the packaging bag; a bottle which is attached at its bottom, by the action of vacuum, to a vacuum pad fixed at the tip of an inserting rod is inserted into the open end of the packaging bag with the inserting rod in a manner that the top of the packaging bottle is inserted first; and the packaging bag is fitted to the outside of the bottle; and (B) a process in which the bottle and the packaging film fitted to the outside of the bottle are heated; the packaging bag is allowed to shrink; and a packaging bottle is prepared.

6. An apparatus for preparation of packaging bags for bottles which comprises: means of making an open end of a packaging bag widely open by holding outside of the packaging bag by the action of vacuum pads wherein the packaging bag is prepared by closing an end of cylindrical film sheet made of heat shrinking material by heat sealing in arch shape and leaving the other end of the cylindrical film sheet open; means of inserting a flapper into the open end of the packaging bag in a synchronized action with the action of making the open end of the packaging bag widely open; means of inserting a bottle fixed at the tip of a rod by the action of a vacuum pad into the open end of the packaging bag; and means of heat shrinking the packaging bag fitted to the bottle by heating.

Other and further objects, features and advantages of the invention will appear more fully from the following description.

BRIEF DESCRIPTION OF THE DRAWINGS

The invention will be described with reference to the accompanying drawings, wherein.

Figure 1:
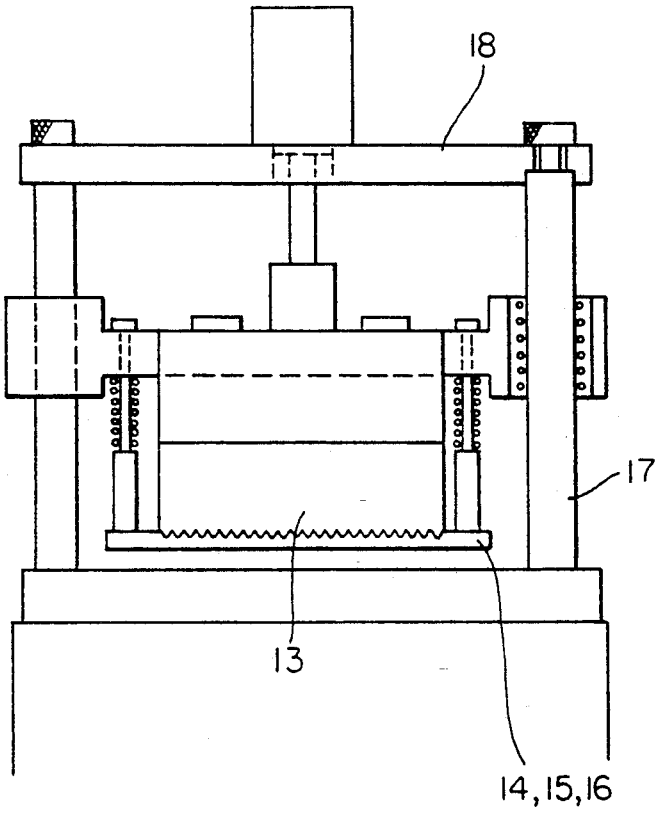
FIG. 1 is a elevational view and FIG. 2 is a side elevational view of an example of the apparatus of the invention.

Figures in the drawings show: 1; a cutting and heat sealing table, 2; an outlet hole, 3; a heat sealing blade of arch shape, 4; a scrap piece receiver, 5; a cylinder, 5'; a cylinder, 6; a nozzle for injection, 7; a cutting blade of straight shape, 8; a cutting blade of arch shape, 9; a sliding block, 10; a needle for a vent hole, 11; a heater, 12; a piston, 13; a jagged blade, 14; a film stopper, 15; a film stopper; 16; a film stopper, 17; a supporting pole, 18; a plate, 19; film sheet, 25; film sheet in a form of roll, 26; a printer, 27; a pinch roll, 30; a vacuum pad, 31; a flapper, 32; a rod, 33; a bottle, 34; a vacuum pad, 35; a nozzle for hot air, 36; a shrink tunnel, 41; a packaging bag, 42, a table for fixing a cylinder, 43; a cylinder, 44; a bracket, 45; a cylinder, 46; a vacuum pad, 47; a vacuum pad, 48; a cylinder 49; a cutting and heat sealing table, 50; a device for fixing a flapper, 51; a pin; 52; a spring, 53; a cylinder, 54; a flapper, 55; a guide, 56; a guide bar 57; a lever, 58; a pivot, 59; a supporting piece, 60; a frame, 61; a plate for fixing a guide, 62; a bottle, 63; a large vacuum pad, 64; a rotating cylinder, 65; a cylinder, 66; a nozzle for hot air, and 67; a conveyer.

DESCRIPTION OF THE PREFERRED EMBODIMENTS

The invention is described in more detail in the following.

The heat shrinking packaging bag utilized in the invention is a cylindrical film sheet in which one of the two ends is closed by heat sealing and the closed end is formed to a curved shape like an arch. A suitable shape of the arch is selected according to the shape of the bottle to which the packaging bag is fitted. When the packaging bag is fitted over the packaging bottle from the top of the bottle and the packaging bag is allowed to shrink by heating, film sheet at the corners of the packaging bag should not be left separated from the face of the bottle but should be tightly fitted all around. A shape of arch satisfying this condition can be utilized as the shape of arch in the invention.

Any kind of film having the heat shrinking property can be utilized as the heat shrinking film in the invention. Examples of the film having heat shrinking property are: uniaxial oriented film and biaxial oriented film of thermoplastic resins, such as polyethylene, polypropylene, polyester, polystyrene, polyvinyl chloride and the like. Uniaxial oriented film are preferably utilized as the heat shrinking film of the invention. Uniaxial oriented film having the coefficient of heat shrinkage parallel to the direction of drawing in the range from 0 to 30% and the coefficient of heat shrinkage perpendicular to the direction of drawing in the range from 20 to 60% are particularly preferable.

However, coefficient of heat shrinkage of the film utilized in the invention is not particularly limited. Suitable films can generally be selected from films having coefficient of heat shrinkage in the range from 5 to 85%, preferably in the range from 10 to 50% and utilized in the invention.

Thickness of the film utilized in the invention is not particularly limited but can be suitably selected according to requirements for properties. Films having the thickness in the range from 10 to 100 μm are generally utilized and films having the thickness in the range 10 to 50 μm are preferably utilized in the invention.

Shape and size of the bottles utilized in the invention are not particularly limited. Narrow neck bottles having section of approximately circular shape or approximately elliptical shape are preferably utilized. Examples of such bottles are bottles utilized for containing toiletries, foods, detergents and the like other commercial products.

Size and shape of the closed end of arch shape of the packaging bags suitable for preparation of the packaging bottles are selected according to the shape and size of the bottles which are to be used.

Material of the bottles utilized in the invention is not particularly limited. Bottles made of plastics, glass, metal, paper, composites of these materials and like other materials can be utilized.

As the method of feeding an end part of a long cylindrical film sheet made of heat shrinking film intermittently by the length of a cutting unit along a cutting and heat sealing table, generally known methods in the process of preparation of bags can be utilized. Examples of such generally known methods are a method utilizing a roll which works periodically for a definite length of time, a method in which a feed pinch roll is stopped by sensing a printed mark on the film sheet by a photoelectric tube, followed by re-starting of the feed pinch roll in the action connected with a designated operation and other like methods.

The end part of the long cylindrical film sheet made of heat shrinking film has a length approximately the same with the length of unit to be cut off.

The length of feeding of the long cylindrical film sheet made of heat shrinking film at one time is exactly the same as the length of unit to be cut off.

The end part of the long cylindrical film sheet made of heat shrinking film is the open end of the packaging bag in one case and the scrap piece in the other case.

Firstly, the case in which the end part is the open end of the packaging bag is described in the following.

When the end part of the long cylindrical film sheet is fed to the cutting and heat sealing table in the apparatus of preparation of packaging bags for bottles, the end part is fixed to the table by zigs for fixing film sheet.

The cutting and heat sealing table may be placed either horizontally or vertically.

A heat sealing blade of arch shape and a cutting blade of straight shape which work in a synchronized action with the action of feeding of the long cylindrical film sheet are fixed at the positions above the table.

The long cylindrical film sheet can be heat sealed and cut by pressing the heat sealing blade of arch shape against the face of the long cylindrical film sheet. It is preferable for the purpose of easier operation of cutting that the scrap piece formed is moved away from the heat sealed part after the heat sealing is done. As the method of moving the scrap piece away from the heat sealed part, various methods can be utilized, such as moving the scrap piece away by holding the scrap piece by a holding device. The scrap piece can be moved to various directions. It is preferable that the scrap piece is moved to the direction perpendicular to the line of heat sealing because it makes the operation of cutting off of the scrap piece easier.

The heat sealing blade of arch shape and the cutting blade of straight shape are preferably fixed to a sliding block faced to the cutting and heat sealing table in positions which make the tips of the heat sealing blade and the cutting blade lie in approximately the same plane so that the cuttings can be done approximately simultaneously.

When the sliding block is moved to the cylindrical film sheet fixed at the cutting and heat sealing table, the closing end of the packaging bag to be prepared is heat sealed by the heat sealing blade of arch shape, the periphery of the closed end is cut off and the open end of the next packaging bag is formed by cutting the long cylindrical film sheet by the cutting blade of straight shape.

By moving the sliding block away from the heat sealed film sheet to the direction perpendicular to the face of the film sheet, the scrap piece separated from the cylindrical film sheet can be discharged from the cutting and heat sealing table in a synchronized action with the action of cutting operation of the sliding block. This operation is preferred because the scrap piece can be discharged from the table by either suction or blowing of air and like other methods.

Means of discharging the scrap piece from the table works immediately after the operation of cutting in a synchronized action with the action of the cutting.

The operation of cutting the peripheral part of the heat sealed part may be done by a cutting blade of arch shape fixed at a position parallel to the heat sealing blade of arch shape. In this case, the heat sealing blade of arch shape works as the tool for heat sealing alone and does not work as the tool for cutting. The cutting blade of arch shape and the cutting blade of straight shape are preferably fixed to a sliding block faced to the cutting heat sealing table in positions which make the tips of the heat sealing blade and the cutting blade lie in approximately the same plane so that the cuttings can be done approximately simultaneously.

The method in which both of the heat sealing and the cutting are made by the heat sealing blade of arch shape alone is more suitable for film sheet of polyvinyl chloride. The method in which the heat sealing is made by the heat sealing blade of arch shape and the cutting is made by the cutting blade of arch shape is more suitable for film sheet of polyethylene terephthalate and film sheet of polypropylene.

When the heat sealing blade of arch shape, the cutting blade of arch shape and the cutting blade of straight shape are all fixed to a single sliding block, the cutting blade of arch shape is fixed at the inner periphery of the heat sealing blade of arch shape.

The above described method in which the end part of the long cylindrical film sheet fed to the cutting and heat sealing table is the open end of the packaging bag is more preferable than the method in which the end part is the scrap piece because the operation of discharge of the scrap piece is easier.

Secondly, the case in which the end part of the long cylindrical film sheet is the scrap piece is described in the following.

When the end part of the long cylindrical film sheet is fed to the cutting and heat sealing table in the apparatus of preparation of packaging bags for bottles, the end part is fixed to the table by zigs for fixing film sheet.

The cutting and heat sealing table may be placed either horizontally or vertically.

A heat sealing blade of arch shape and a cutting blade of straight shape which work in a synchronized action with the action of feeding of the long cylindrical film sheet are fixed at the positions above the table.

The long cylindrical film sheet can be heat sealed and cut by pressing the heat sealing blade of arch shape against the face of the long cylindrical film sheet. It is preferable for the purpose of easier operation of cutting that the scrap piece formed is moved away from the heat sealed part after the heat sealing is done. As the method of moving the scrap piece away from the heat sealed part, various methods can be utilized, such as moving the scrap piece away by holding the scrap piece by a holding device. The scrap piece can be moved to various directions. It is preferable that the scrap piece is moved to the direction perpendicular to the line of heat sealing because it makes the operation of cutting off of the scrap piece easier.

Like the case in which the end part of the long cylindrical film sheet is the open end of the packaging bag, the operation of cutting the peripheral part of the heat sealed part may be done by a cutting blade of arch shape fixed at a position parallel to the heat sealing blade of arch shape. In this case, the heat sealing blade of arch shape works as the tool for heat sealing alone and does not work as the tool for cutting.

The scrap piece at the end of the long cylindrical film sheet is cut off by pressing the cutting blade of straight shape against the face of the film sheet. The scrap piece cut off is discharged from the cutting and heat sealing table by a suitable method, such as by the action of suction or blowing of air.

Means of discharging the scrap piece from the table works immediately after the operation of cutting in a synchronized action with the action of the cutting.

The heat sealing blade of arch shape and the cutting blade of straight shape move by sliding in a synchronized action with the feeding of the long cylindrical film sheet and heat seal, melt cut and cut the cylindrical film sheet by pressing against the film sheet.

It is preferable for efficient preparation of the packaging bag that the heat sealing, melt cutting and cutting are performed approximately simultaneously.

Another feature of the method of preparation of packaging bottles of the invention is the method of widely opening the open end of the packaging bag prepared above, fitting a bottle to the bag and allowing heat shrinking of the bag.

As the method of widely opening the open end of the packaging bag and the method of fitting a bottle into the bag, all of the generally known methods in the preparation of bags can be utilized. It is preferable that the open end of the bag is widely open by the action of vacuum pads attached to both of the upper side and the lower side of the bag and then the bottle is inserted into the bag by inserting the top of the bottle first.

It is preferable that a flapper is inserted into the widely open end of the packaging bag before the bottle is inserted into the bag and then the bottle is inserted into the flapper.

The packaging bottle can be prepared by allowing the packaging bag made of heat shrinking film sheet which is fitted outside of the bottle heat shrink by heating.

The heat shrinking is performed by heating the bag to the heat shrinking temperature of the film utilized.

The method of heating can be selected from the generally known methods according to the contents of the bottle and other conditions. Examples of the such generally known methods are: passing through a shrink tunnel by using a conveyer, injection of hot air, irradiation of infrared light and the like.

It is preferable in the present invention that the packaging bag is temporarily fitted to the bottle by the process of preliminary heat shrinking. In the process of preliminary shrinking of the invention, the area of the open end of the packaging bag is locally heated and only the heated area of the bag is fixed to the bottle. It is particularly preferable that area of the open end of the bag is locally heated and allowed to shrink partially when the open end of the bag is slightly longer than the bottom of the bottle inserted into the bag because, in this condition, the bag is stretched between the cap and the bottom of the bottle and the temporary fixing of the bag to the face of the bottle is made firm.

By the process of the preliminary heat shrinking of the bag, defect packaging because of moving of packaging bag during transfer of the bottle from the insertion process to the heat shrinking process by using a conveyer and the like can be prevented even when the bottle experiences shock from outside.

As is generally practiced, a vent hole may be made in the bag by using a needle before the process of heat shrinking to remove air trapped inside and to make the bag fit to the face of the bottle more tightly.

The packaging bottle can be continuously prepared by the methods described above.

Another feature of the invention is the method of preparation of packaging bottles comprising (A) a process in which the open end of a packaging bag prepared by closing an end of a cylindrical film sheet made of heat shrinking film as the material by melting in an arch shape and leaving the other end of the cylindrical film sheet open is made widely open by pulling from the outside of the cylindrical film sheet by the action of vacuum pads attached to the outside of the cylindrical film sheet, followed by separating the vacuum pads from each other; a flapper is inserted into the open end of the packaging bag; a bottle which is attached at its bottom, by the action of vacuum, to a vacuum pad fixed at the tip of an inserting rod is inserted into the open end of the packaging bag with the inserting rod in a manner that the top of the packaging bottle is inserted first; and the packaging bag is fitted to the outside of the bottle; and (B) a process in which the bottle fitted with the packaging film is heated; the packaging bag fitted to the outside of the bottle is allowed to shrink; and a packaging bottle is prepared.

This feature of the invention is characterized in the method of insertion of the bottle into the bag.

The insertion of the bottle into the bag is performed smoothly by the method of widely opening the open end of the bag by the action of vacuum pads attached to both of the upper side and the lower side of the bag, inserting a flapper made of metal, hard plastics and the like to guide the insertion of the bottle smoothly and inserting the bottle into the flapper thus inserted into the bag.

When the bottle is inserted into the flapper, the bottle is fixed at the tip of a piston rod which makes reciprocal movement. When the rod moves forward, the rod inserts the bottle fixed at its tip by means of a vacuum pad attached at the tip of the rod into the flapper and the bag. The bottle is liberated from the rod by stopping suction of the vacuum pad when the rod is at maximum position in its forward movement. The rod makes backward movement without the attached bottle. Another bottle is fixed at the tip of the rod by suction of the vacuum pad when the rod returns to the starting position and the rod makes next forward movement to insert the next bottle into the bag. Part of the bottle at which the rod is fixed is not particularly limited but bottom of the bottle is preferable. The suction by the vacuum pad is not always necessary depending on the shape of the bottle but it is preferable to have the suction by a vacuum pad because the tip of the piston rod is more firmly fixed to the the bottle.

The invention will be understood more readily with reference to the following examples; however these examples are intended to illustrate the invention and are not to be construed to limit the scope of the invention.

Figure 2:
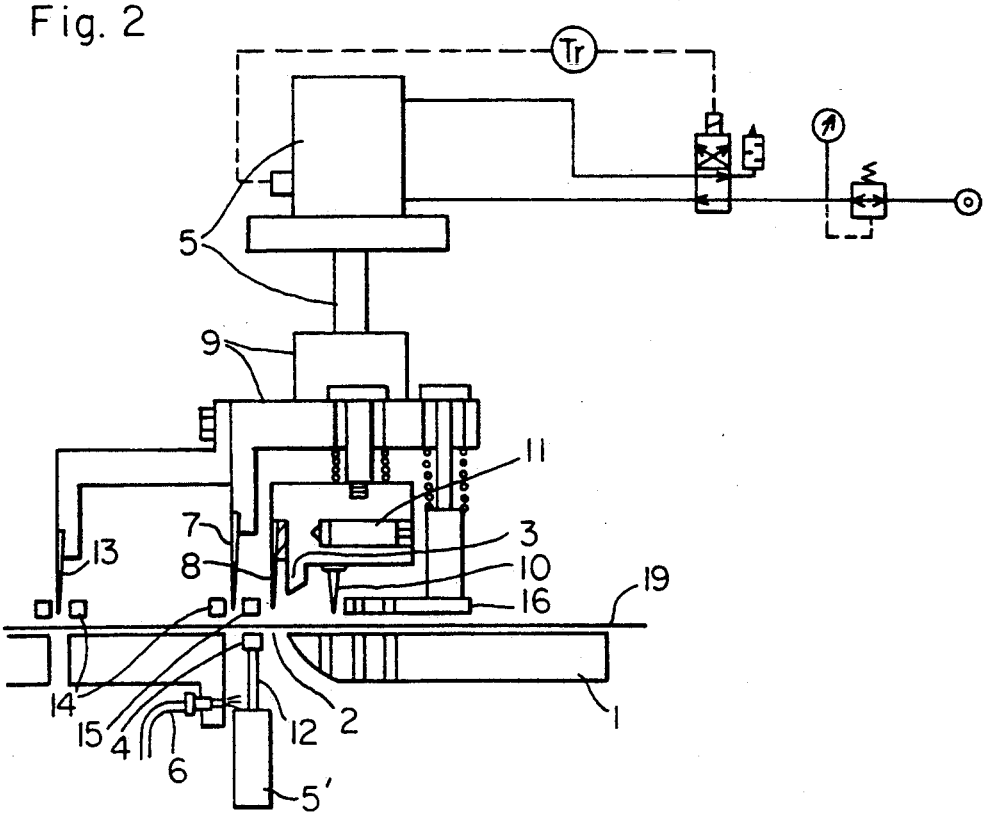
Figure 5:
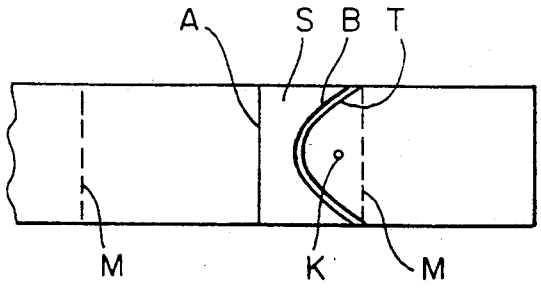
FIG. 5 and FIG. 6 show portions of the cylindrical film sheet on which the apparatus of the invention works.
Figure 6:
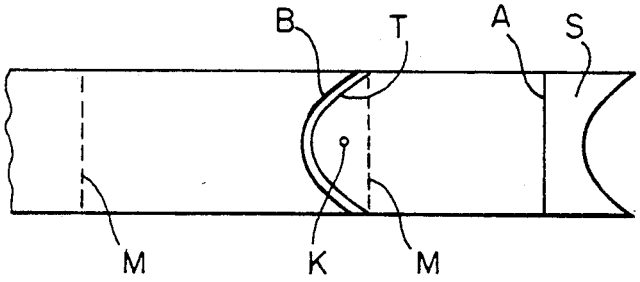

FIG. 1 and FIG. 2 show an example of the apparatus of the invention. This apparatus continuously prepares heat shrinking packaging bags for bottles by processing the end part of the long cylindrical film sheet having the open end at its end, as shown in FIG. 5, by cutting the film sheet to form the open end A of the bag, heat sealing the closed part of arch shape T, cutting periphery of the closed part of arch shape B to form the closed end of the bag, opening a vent hole K, making of perforations M and smooth discharge of a scrap piece S.

The apparatus of the invention composed mainly of a cutting and heat sealing table 1 having an outlet hole for a scrap piece 2 at the center, a sliding block 9 which moves by sliding in reciprocal movement by the action of a cylinder 5 which is fixed to a pole on the table and a scrap piece receiver 4 placed under the table as a tool for discharging the scrap piece.

The cutting and heat sealing table is placed horizontally. A cutting blade of straight shape 7, a cutting blade of arch shape 8 and a heat sealing blade of arch shape 3 heated by a heater 11 are fixed to the sliding block 9. The cutting blade of straight shape 7 and the cutting blade of arch shape 8 are fixed to the sliding block so that the tips of the two blades lie in the same plane. The heat sealing blade of arch shape 3 is fixed to the sliding block 9 so that the tip of the heat sealing blade lies in a plane slightly higher than the plane of the tips of the cutting blades. The cutting of the scrap piece can be easily performed because tips of the cutting blade of straight shape 7 and the cutting blade of arch shape are placed in the same plane.

The sliding block 9 moves vertically by the action of reciprocal movement of cylinder 5. When the sliding block is at the lowest position, the tip of the heat sealing blade of arch shape 3 is in contact with the face of the cutting and heat sealing table 1 and the tips of the two cutting blades are in a position passing through the surface of table 1 at the edge of the outlet hole at the center of the table.

Figure 7:
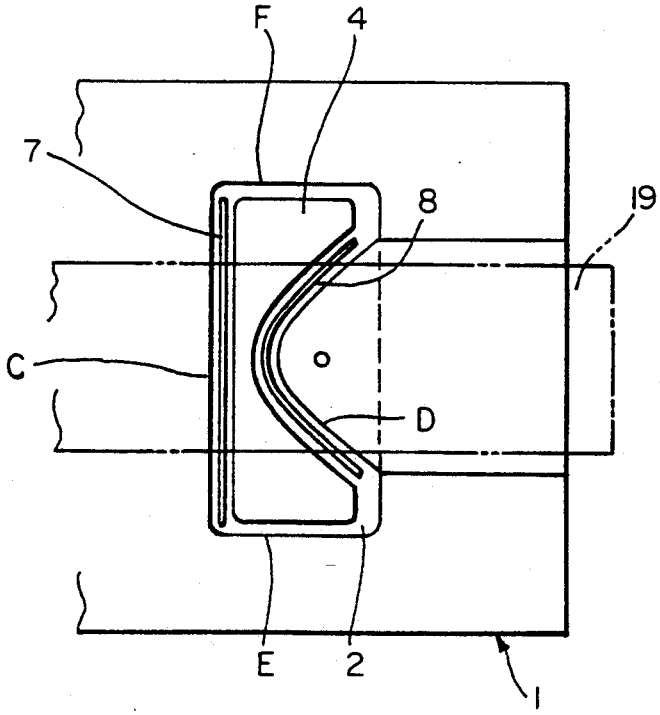
FIG. 7 is a projection drawing from upper position showing relative positions of a cutting blade of straight shape, a cutting blade of arch shape, a scrap piece receiver and tip of the cylindrical film sheet in relation to the position of outlet hole of the cutting and heat sealing table in the examples of the apparatus of the invention.

Relative positions of the scrap piece receiver 4, the cutting blade of straight shape 7 and the cutting blade of arch shape 8 in relation to the outlet hole at the center of the table 1 are shown in FIG. 7 which is the projection drawing from the upper position. The cutting blade of straight shape 7 and the cutting blade arch shape 8 are placed at positions between the edge of the outlet hole 2 and the edge of the scrap piece receiver 4 so that the two blade do not make contact with the table 1.

The shape of curvature of the edge D is the same as the shape of the curvature of the closing end of the bag T or the cutting blade of arch shape B. The distance between the edge C and the edge D of the outlet hole is slightly larger than the width of the scrap piece.

The distance between the edge E and the edge F of the outlet hole is larger than the width of the cylindrical film sheet.

The edge D of the outlet hole functions as the receiving edge of the cutting blade of arch shape 3.

In addition to the elements described above, a jagged blade 13 for the perforations and a needle 10 for the vent hole are fixed to the sliding block 9.

Function of the invention is explained in the following.

The end part of the long cylindrical film sheet is fed to the cutting and heat sealing table 1 intermittently by a generally known method. Examples of such generally known methods are a method utilizing a roll which works periodically for a definite length of time, a method in which a feed pinch roll is stopped by sensing a printed mark on the film sheet by a photoelectric tube, followed by re-starting of the feed pinch roll in the action connected with a designated operation and other like methods.

The length of feeding of the long cylindrical film sheet made of heat shrinking film at one time is exactly the same as the length of unit to be cut off.

Stoppers for the film sheet 14, 15 and 16 which are placed at three positions, in the front, in the middle and in the rear of the two cutting blades, move downward to the face of the cutting and heat sealing table 1 to fix the film sheet to the table in a synchronized action with the action of feeding of the end part of the long cylindrical film sheet.

The scrap piece receiver 4 moves upward in a synchronized action with the downward movement of the stopper 15 for the film sheet and the part of the film sheet which is to become the scrap piece is firmly held by the scrap piece receiver 4 and the stopper 15.

When the scrap receiver 4 makes contact with the film sheet, a suction hole at the upper face of the scrap piece receiver 4 starts suction of air and holds the film sheet by the suction.

Erroneous movement of the film sheet apart from the designated position by the tension at the time of cutting can be prevented because the cutting and heat sealing are performed after the end part of the long cylindrical film sheet is firmly fixed to the cutting and heat sealing table.

The sliding block 9 moves downward in an action slightly delayed from the downward movement of the stoppers for the film sheet. The cutting blade of straight shape 7 and the cutting blade of arch shape 8 cut the cylindrical film sheet and the scrap piece S is separated from the film sheet.

The heat sealing blade of arch shape 3 is pressed against the peripheral part of cut end of arch shape approximately simultaneously with the operation of cutting and the end of arch shape is heat sealed to form the closed end of the packaging bag. The heat sealing blade of arch shape 3 is a heat sealing blade made of a material such as steel and having a narrow flat part at the tip. The heat sealing blade is heated by a heater 11 and heat seals the two component sheets of the cylindrical film sheet by pressing at the peripheral part D to form the closed end T of the packaging bag.

The tip of the heat sealing blade of arch shape 3 is fixed at a position slightly higher than the tips of the cutting blade of straight shape 7 and cutting blade of arch shape 8. The part of the film sheet can be heat sealed approximately simultaneously with the cutting operation of the film sheet.

The scrap piece S separated from the film sheet by the cutting operation described above is held by the scrap piece receiver 4 by suction. Then, the scrap piece receiver 4 moves downward when the sliding block 9 moves upward and, when the scrap piece receiver comes to the position of a nozzle for injection of compressed air 6, the suction is stopped and the scrap piece is left free. The scrap piece is then transferred to a scrap piece vessel by the injection of air stream through the air injection nozzle 6 and/or the suction hole of the scrap piece receiver. Mechanical transfer of the scrap piece can be utilized in place of the transfer by air injection.

As another example of the invention, the scrap piece may be discharged by the action of air stream through the outlet hole of the table 1 to the outside of the apparatus generated by means of a vacuum pump or an air compressor without utilizing suction of the scrap piece receiver.

When the cutting off of the packaging bag and the scrap piece is finished, the sliding block 9 and the film stoppers 14, 15 and 16 move upward and the packaging bag prepared and the end part of the cylindrical film sheet for the next unit are made free on the table 1. The packaging bag prepared is transferred to the next stage of the process. The end part of the long cylindrical film sheet for the next unit is fed and the process is repeated all over again.

For the upward and downward movements of the film stoppers and the scrap piece receiver, movements by generally known driving systems can be utilized. For example, upward and downward reciprocal linear movements by a cylinder or reciprocal non-linear movement by a cyclic movement of an arm may be utilized.

Packaging bags were prepared continuously and smoothly from cylindrical uniaxial oriented film sheet of polyethylene terephthalate having thickness of 25 μm and coefficient of shrinkage of 15% parallel to the direction of drawing and 35% perpendicular to the direction of drawing by utilizing the apparatus of the invention.

Figure 3:
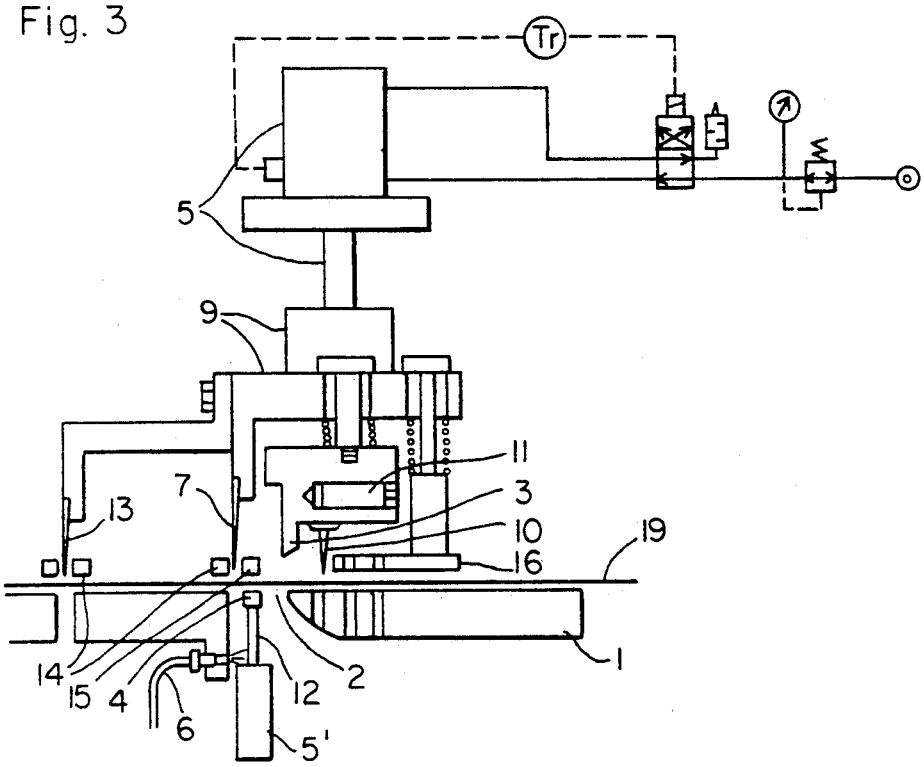
FIG. 3 and FIG. 4 are an elevational views of two other examples of the apparatus of the invention.

FIG. 3 shows another example of the apparatus of the invention. This apparatus is similar to the apparatus shown in FIG. 2 but different in that this apparatus does not have a cutting blade of arch shape.

In this apparatus, the tip of the heat sealing blade of arch shape 3 is fixed to the sliding block 9 at a position slightly higher than the position of the tip of the cutting blade of straight shape.

The sliding block 9 moves vertically by the action of reciprocal movement of cylinder 5. When the sliding block is at the lowest position, the tip of the heat sealing blade of arch shape 3 is in contact with the face of the cutting and heat sealing table 1 and the tip of the cutting blade of straight shape is in a position passing through the surface of table 1 at the edge of the outlet hole at the center of the table.

Stoppers for the film sheet 14, 15 and 16 which are placed at three positions, in the front, in the middle and in the rear of the heat sealing blade of arch shape and the cutting blade of straight shape, move downward to the face of the table 1 to fix the film sheet to the table in a synchronized action with the action of feeding of the end part of the long cylindrical film sheet.

The scrap piece receiver 4 moves upward in a synchronized action with the downward movement of the stopper for the film sheet 15 and the part of the film sheet which is to become the scrap piece is firmly held by the scrap piece receiver 4 and the stopper 15.

When the scrap receiver 4 makes contact with the film sheet, a suction hole at the upper face of the scrap piece receiver 4 starts suction of air and holds the film sheet by the suction.

Erroneous movement of the film sheet apart from the designated position by the tension at the time of cutting can be prevented because the cutting and heat sealing are performed after the end part of the long cylindrical film sheet is firmly fixed to the cutting and heat sealing table.

The sliding block 9 moves downward in an action slightly delayed from the downward movement of the stoppers for the film sheet. The cutting blade of straight shape 7 cuts the cylindrical film sheet and the heat sealing blade of arch shape 3 heat seals the cylindrical film sheet. The tip of the heat sealing blade of arch shape 3 is fixed at a position slightly higher than the tip of the cutting blade of straight shape 7 and the part of the film sheet can be heat sealed approximately simultaneously with the cutting operation of the film sheet by the cutting blade of straight shape. After the closed end of arch shape of the packaging bag is formed by the heat sealing, the scrap piece receiver 4 and the film stopper 15 move downward while the scrap piece S is firmly held and the scrap piece S is torn apart and separated by this movement from the film sheet at the part of closed end of the packaging bag.

The scrap piece S separated from the film sheet by the cutting operation described above is held at the scrap piece receiver 4 by the action of suction and the film stopper 15 moves upward. The scrap piece receiver 4 moves further downward and, when the scrap piece receiver comes to the position of a nozzle for injection of compressed air 6, the suction is stopped and the scrap piece S is left free. The scrap piece is then transferred to a scrap piece vessel by the injection of air stream through the air injection nozzle 6 and/or the suction hole of the scrap piece receiver. Mechanical transfer of the scrap piece can be utilized in place of the transfer by air injection.

Other functions and operations are performed in the same way as in the apparatus of FIG. 2.

Packaging bags were prepared continuously and smoothly from cylindrical uniaxial oriented film sheet of polyvinyl chloride having thickness of 30 μm and coefficient of shrinkage of 20% parallel to the direction of drawing and 50% perpendicular to the direction of drawing by utilizing the apparatus of the invention.

In the example of the apparatus of the invention described above, the cutting blade of straight shape, the cutting blade of arch shape and the heat sealing blade of arch shape are placed in this order following the movement of the long cylindrical film sheet. In another example of the invention, the heat sealing blade of arch shape, the cutting blade of arch shape and the cutting blade of straight shape can be placed in this order following the movement of the long cylindrical film sheet. In this case, the direction of feeding of the long cylindrical film sheet can be the same as the direction of feeding the bottle.

Figure 4:
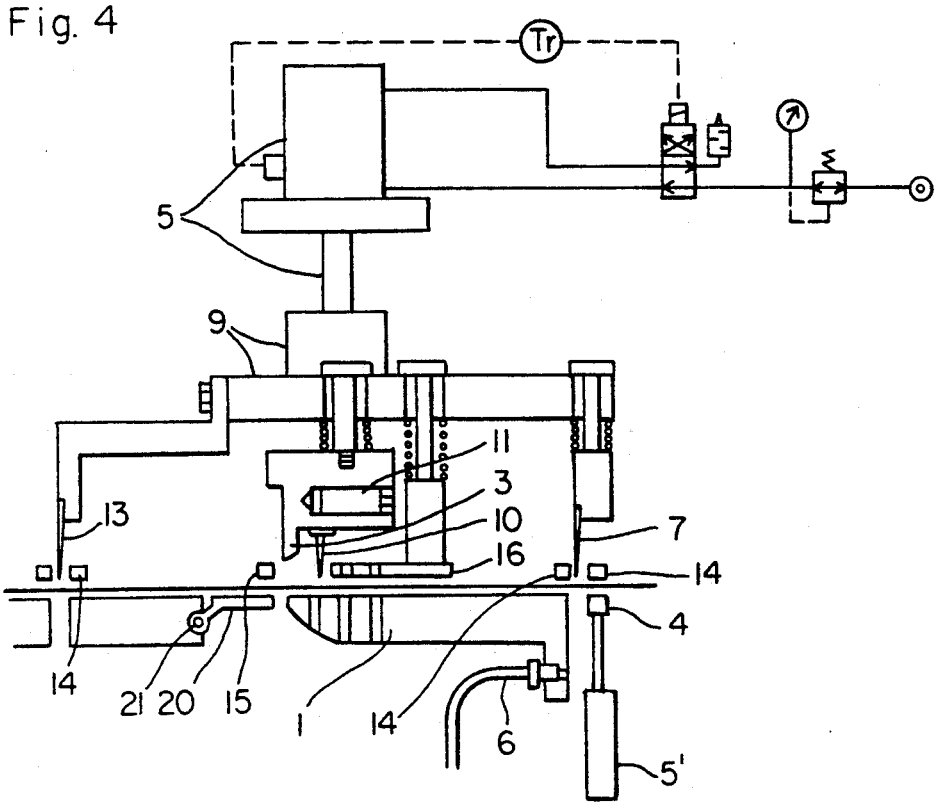

FIG. 4 shows another example of the apparatus of the invention. In this example, the open end A of the packaging bag and the peripheral part B of the closing end of the bag are cut off from the long cylindrical film sheet having the scrap piece at the end part, the closing end of arch shape T of the packaging bag is heat sealed, the vent hole K is opened, perforations M are made, the scrap piece S is discharged smoothly and, thus, heat shrinking packaging bags for bottles are continuously prepared.

The apparatus of this example is composed mainly of a cutting and heat sealing table 1 having means of discharging a scrap piece at its end, a sliding block 9 which makes reciprocal movement by sliding by the action of a cylinder 5 fixed to a pole and a scrap piece receiver 4 which is used as the means of discharging a scrap piece placed at the end of the cutting and heat sealing table 1.

A cutting blade of straight shape 7 and a heat sealing blade of arch shape 3 heated by a heater 11 are fixed to the sliding black 9.

The sliding block 9 moves vertically by the action of reciprocal movement of cylinder 5. When the sliding block is at the lowest position, the tip of the heat sealing blade of arch shape 3 is in contact with the face of the cutting and heat sealing table 1 and the tip of the cutting blade of straight shape 7 is in a position passing through the surface of table 1 at the edge of the outlet hole at the center of the table.

A jagged blade 13 for perforations and a needle 10 for a vent hole are fixed to the sliding block 9 as well as the elements described above.

Functions of the apparatus of this example is described in the following.

End part of a long cylindrical film sheet is fed intermittently to the cutting and heat sealing table 1 by the methods described above in the same way as the preceding examples.

Stoppers for the film sheet 14, 15 and 16 which are placed at three positions, in the front, in the middle and in the rear of the two blades of the present example, move downward to the face of the table 1 to fix the film sheet to the table in a synchronized action with the action of feeding of the end part of the long cylindrical film sheet.

The scrap piece receiver 4 moves upward in a synchronized action with the downward movement of the stopper for the film sheet 14 and the part of the film sheet which is to become the scrap piece is firmly held by the scrap piece receiver 4 and the stopper 14.

When the scrap receiver 4 makes contact with the film sheet, a suction hole at the upper face of the scrap piece receiver 4 starts suction of air and holds the film sheet by the suction.

Erroneous movement of the film sheet apart from the designated position by the tension at the time of cutting can be prevented because the cutting and heat sealing are performed after the end part of the long cylindrical film sheet is firmly fixed to the cutting and heat sealing table 1.

The sliding block 9 moves downward in an action slightly delayed from the downward movement of the stoppers for the film sheet. The cutting blade of straight shape 7 cuts the cylindrical film sheet and the scrap piece S formed is separated from the film sheet.

Approximately simultaneously with the cutting off of the scrap piece, the heat sealing blade of arch shape 3 is pressed against the periphery of the cut edge of arch shape of the film sheet and the film sheet is heat sealed to form the closed end of the packaging bag. The heat sealing blade of arch shape 3 is a heat sealing blade made of a material like steel and having a narrow flat part at the tip and heated by a heater 11. The heat sealing blade of arch shape is pressed against the film sheet fixed on the cutting and heat sealing table and two component sheets of the film sheet are heat sealed to form the closed end of the packaging bag. When the closed end of arch shape of the bag is formed by heat sealing, a film sheet holder 20 and the film stopper 15 move downward by rotating around an axis 21 while holding the film sheet firmly between them. The film sheet is torn off from the closed part of arch shape of the bag by this movement and the bag is separated from the film sheet. The film stopper 15 is fixed at a position along the heat sealing blade of arch shape so that separation of the bag and the film sheet is made easily. By the method described above, heat sealing of the closing end of the packaging bag and cutting of the peripheral part of the closed end of the bag can be performed approximately simultaneously.

Cutting of the bag from the cylindrical film sheet may be performed by means of a cutting blade of arch shape which is fixed at a position along the heat sealing blade of arch shape.

After the packaging bag is separated from the cylindrical film sheet, the film sheet holder and the film sheet stopper 15 move upward and return to the original position.

The tip of the heat sealing blade of arch shape 3 is fixed at a position slightly higher than the tip of the cutting blade of straight shape 7 and the closing part of the bag can be heat sealed approximately simultaneously with the cutting of the film sheet.

The scrap piece S separated from the film sheet by the cutting operation described above is held at the scrap piece receiver 4 by suction. The scrap piece receiver 4 moves downward while the sliding block 9 moves upward. When the scrap piece receiver comes to the position of a nozzle for injection of compressed air 6, the suction is stopped and the scrap piece is left free. The scrap piece is then transferred to a scrap piece vessel by the injection of air stream through the air injection nozzle 6 and/or the suction hole of the scrap piece receiver. Mechanical transfer of the scrap piece can be utilized in place of the transfer by air injection.

The cutting blade of straight shape is not limited to those moving downward and upward but may be fixed to the face of a roll. When the cutting blade of straight shape fixed to the face of a roll is utilized, the open end of the bag is cut off intermittently by rotating the roll. The cylindrical film sheet can be firmly held by the roll at all times because the roll is always in contact with the film sheet. The roll rotates intermittently. It starts rotation after the closing end of the bag is heat sealed and cut and the open end of the bag is cut approximately simultaneously with the cutting of the closed end. The scrap piece formed is discharged by suction to the scrap piece receiver having a suction hole or by injecting air stream to the scrap piece. The roll keeps rotating after cutting off scrap piece and holds the end part of the long cylindrical film sheet for the next unit when the packaging bag thus prepared moves to the next process of fitting a bottle.

Packaging bags were prepared continuously and smoothly from cylindrical uniaxial oriented film sheet of polyvinyl chloride having thickness of 30 μm and coefficient of shrinkage of 20% parallel to the direction of drawing and 50% perpendicular to the direction of drawing by utilizing the apparatus of the invention.

As the means of discharging the scrap piece, stream of air flowing from an end of the cutting and heat sealing table 1 to the outside of the system may be generated by using a vacuum pump or an air compressor and utilized for the discharge without making use of the suction by the scrap piece receiver.

The film stoppers 14, 15 and 16 move upward while the sliding block 9 moves upward. The bag prepared and the end part of the cylindrical film sheet for the next unit are left free on the cutting and heat sealing table. The packaging bag thus prepared is transferred to the next process, the end part of the long cylindrical film sheet for the next unit is fed and the whole process is repeated all over again.

Every part of the apparatus of this example can be driven by utilizing generally known driving system in the same way as in the preceding examples.

Figure 8:
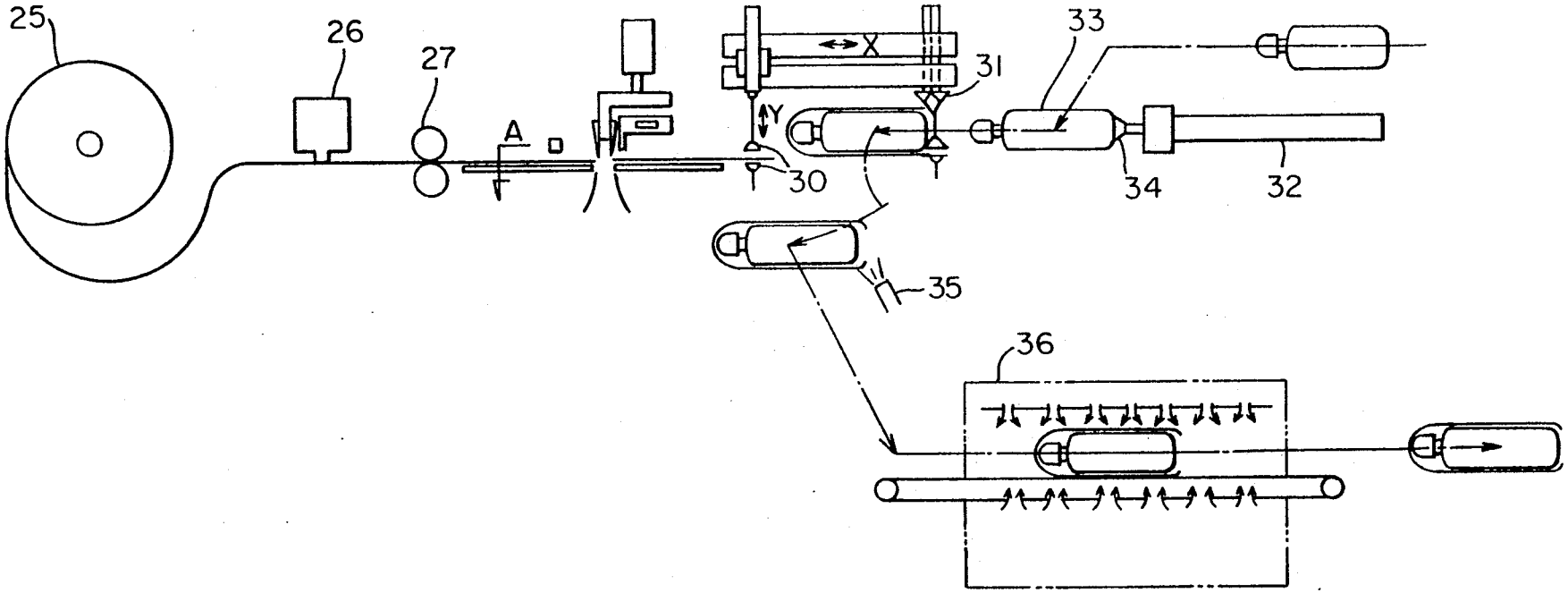
FIG. 8 is a drawing explaining the whole process of preparation of a packaging bottle by the apparatus of the invention.
Figure 9:
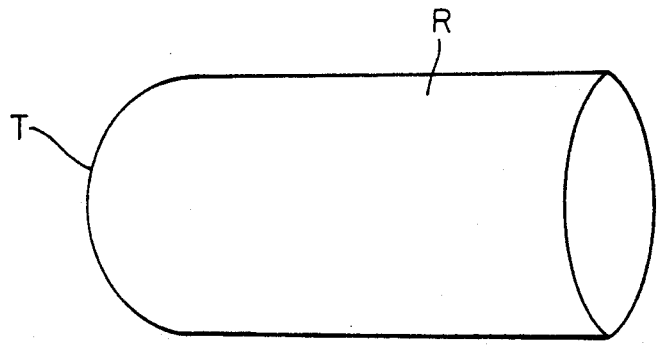
FIG. 9 is a perspective view of a heat shrinking packaging bag utilized for the preparation of a packaging bottle.
Figure 10:
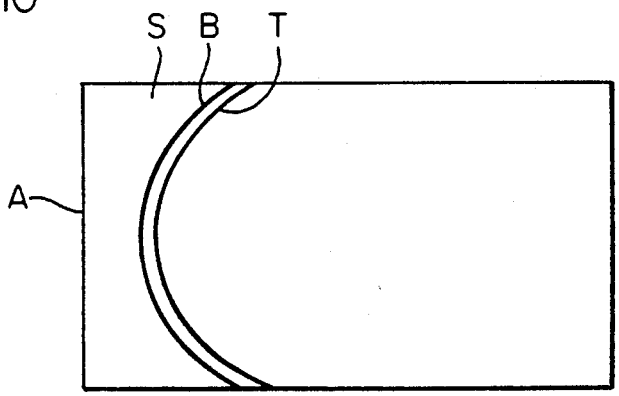
FIG. 10 is a plan view of an intermediate product of a conventional packaging bag for a packaging bottle.

In the practical applications, the methods and apparatus of preparation of packaging bags of the invention can be favorably utilized as parts of a series of packaging processes as shown in FIG. 8.

In the series of processes of FIG. 8, the heat shrinking cylindrical film sheet is supplied from a roll 25 of the long film sheet at the left. The end part of the film sheet is fed intermittently to the cutting and heat sealing table 1 of the apparatus of preparation of packaging bags with a pitch of the designated length of cutting unit. The length of cutting unit can be decided according to the size of bottle, the width of scrap piece and other factors.

Intermittent feeding of the film sheet from the roll of film sheet is made by the action of a pair of pinch rolls 27. Movement of the pinch rolls can be stopped by sensing printed marks on the film sheet by photoelectric tubes.

By using a printer 26 placed immediately before the pinch rolls 27, year, month and date of preparation can be printed on the film sheet.

The packaging bag prepared by the methods and apparatus of the invention is transferred to the next process in which the bag is fitted to a bottle.

The bag transferred to the bottle fitting process is attached with vacuum pads 30 at the both sides of the open end of the bag from outside, suction is effected to the vacuum pads and the open end of the bag is made widely open. It is preferable that the open end of the bag is blown by air. While holding the bag with its open end widely open, the vacuum pads 30 move to the position in front of a flapper 31 which is placed at right of the bottle fitting table shown in FIG. 8. The bag is then fitted to the flapper.

A vacuum pad 34 fixed at the tip of a rod 32 which is, in turn, connected to a vacuum pump is fixed to the bottom of the cylindrical bottle 33 which is to be fitted with the bag. The bottle fixed with the rod 32 is inserted into the flapper 31 in the manner that the top of the bottle is inserted first and, when necessary, with the rotation of the rod.

The operation may be performed without the vacuum pad 34 at the tip of the rod 32 when the shape of the bottle does not require utilizing it. However, the vacuum pad 34 is effective for fixing the rod firmly to the bottle and the utilization of the vacuum pad is preferable.

When the top of the bottle reaches the closed end of the bag, suction of the vacuum pads at the open end of the bag is stopped and the rod is further pushed forward for insertion. By this operation, the open end of the bag is removed from the flapper by slipping.

When the flapper is removed from the bottle, hot air is injected from a hot air nozzle 35 placed at central area of the fitting table to the area of open end of the bag fitted to the bottle and the bag is temporarily fixed over the bottle by partial shrinkage of the bag in the area of the open end. It is preferred that a small portion of the bag beyond the bottom area of the bottle is allowed to shrink because the temporary shrinking of the bag in this portion fixes the bag more firmly to the bottle and the rod 32 can be detached from the bottle.

Another example of fitting of the bag to a bottle makes use of the following bottle fitting apparatus.

Figure 11A:
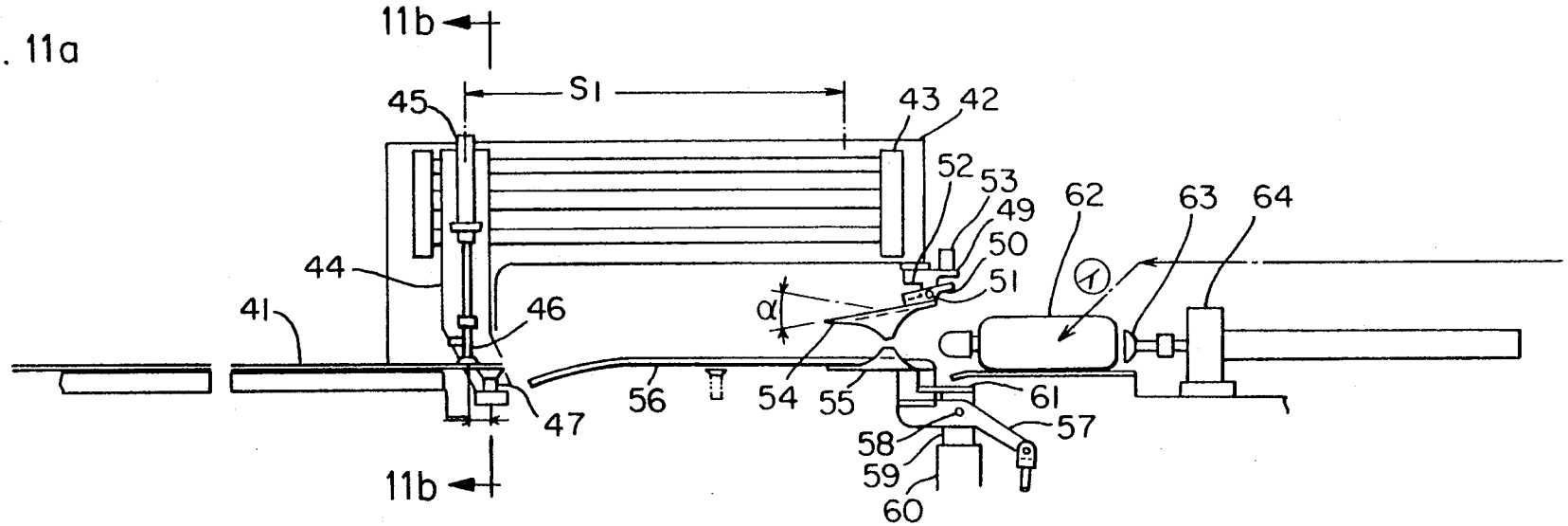
FIG. 11*a*, FIG. 12 and FIG. 13*a* are drawings showing processes of an example of the apparatus for fitting packaging film sheet to a bottle in the apparatus of preparation of a packaging bottle of the invention.
Figure 11B:
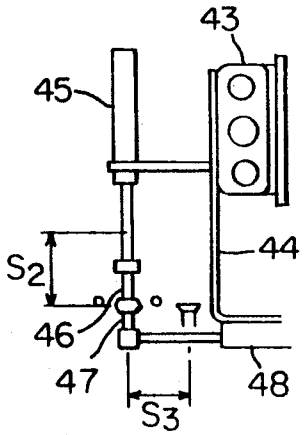
FIG. 11*b* is a sectional view of the apparatus in FIG. 11*a* as seen along line 11*b*—11*b* and FIG. 13*b* is a sectional view of the apparatus in FIG. 13*a* as seen along line 13*b*—13*b*.

The bottle fitting apparatus shown in FIG. 11A has cylinders 45 and 48 which move vacuum pads 46 and 47, respectively, and are fixed to a bracket 44 which moves horizontally on rails.

When the bag is fed to the apparatus for fitting, the vacuum pads 46 and 47 which are placed at slightly shifted positions with each other are attached to the film sheet from the upper side and the lower side of the bag 41, respectively, and fixed to the face of the film sheet by suction. The open end of the bag is made widely open by lifting the upper sheet by pulling up the cylinder 45. While the vacuum pads 46 and 47 hold the end of the bag widely open, the bag is transferred by the movement of the bracket 44 by the action of cylinder 43 until it reaches to the left end of the flapper 54 which is placed at the right of the bottle fitting table shown in FIG. 11*a*.

The bag with its end widely open fits into the insertion structure formed by the flapper 54 and a guide 55 by the movements described above. Before the insertion, insertion position at the right side of the flapper 54 is made more widely open by the action of a spring 52.

At the right of the apparatus for bottle fitting, there is a rotating cylinder structure 64 which makes reciprocal movement of a large vacuum pad 63 fixed at the tip of an inserting rod which is connected to a vacuum system while the vacuum pad is rotating. When the large vacuum 63 is at the right end of its movement, it is attached to the bottom of the bottle which has been transferred by a conveyer and the vacuum pad 63 is fixed to the bottle by strong suction of the pad.

Figure 12:
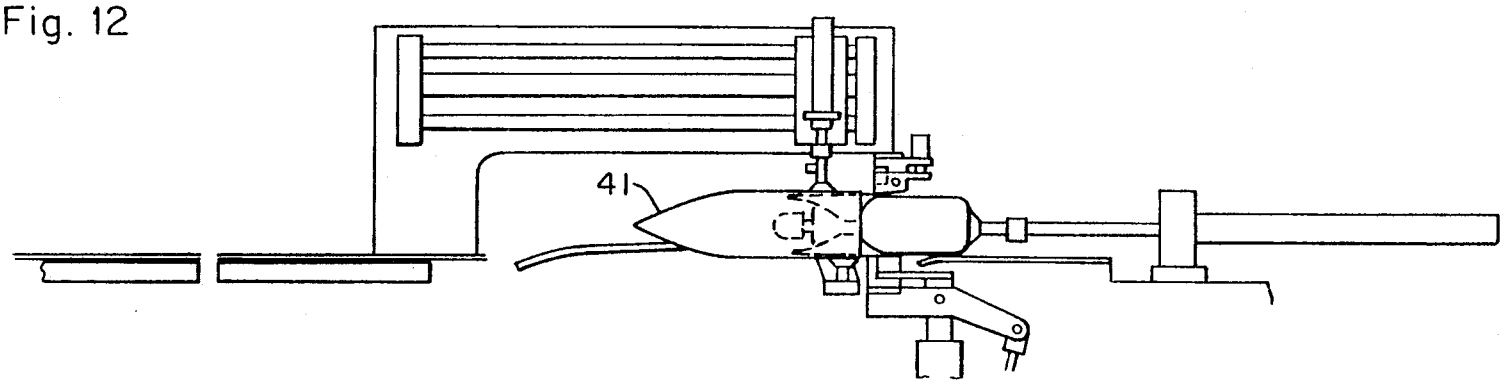

In a synchronized action with the fitting of the bag 41 to the flapper 54, the inserting rod is extended and the bottle 62 is inserted into the inserting pass formed by the flapper 54 and the guide 55 along with the inserting rod as shown in FIG. 12.

When the bottle is inserted, it is preferable that the rod is slowly rotated to achieve smooth slipping of the bag and the bottle. However, the rod may be inserted without rotation depending on the shape of the bottle. When the section of the bottle is not circular, the rod may be given oscillating movement with small degree of rotation in place of the rotating movement.

Figure 13A:
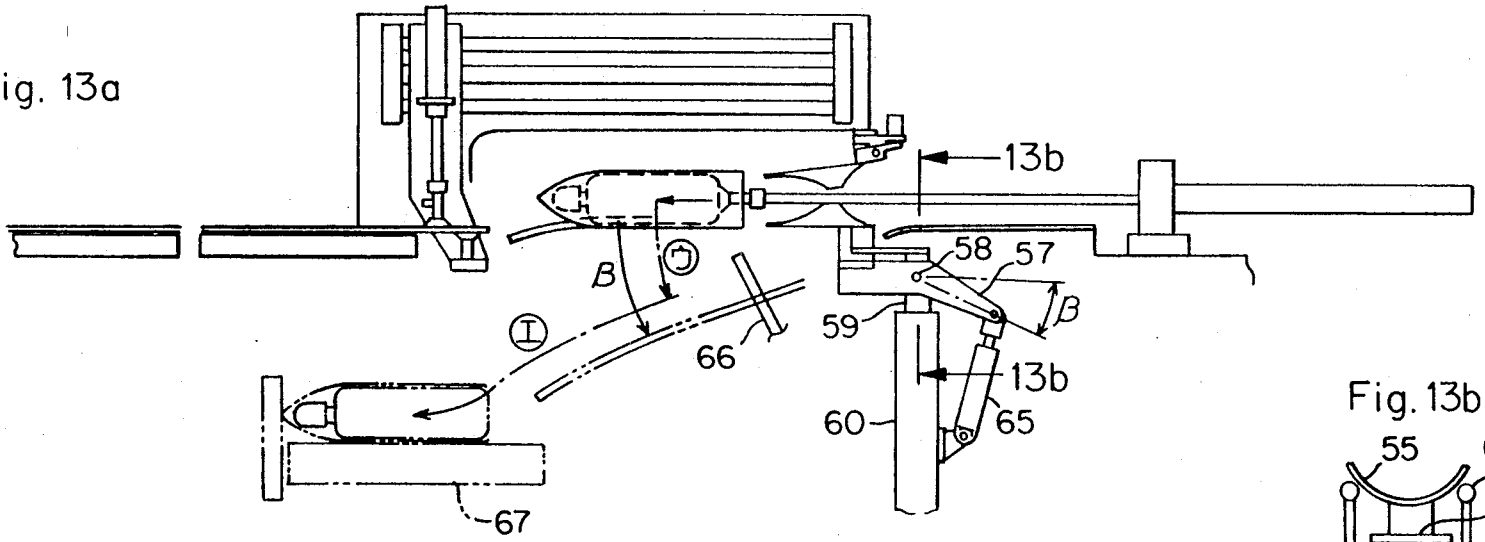
Figure 13B:
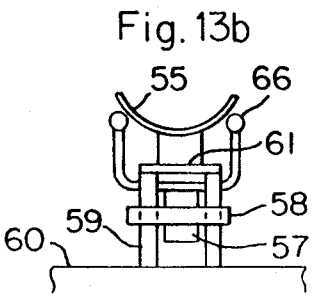

By the inserting movement of the rod, the top of the bottle pushes the closed end of the bag and the open end of the bag is made free from the flapper which has been holding it. The bottle is kept horizontally in the bottle fitting apparatus with the rod through the flapper 54 as shown in FIG. 13*a*.

Then, while the inserting rod is rotated, hot air is injected to heat the area of open end of the bag through a plural number of hot air nozzles 66 fixed inside of the bottle fitting apparatus and thus the bag is allowed to shrink partially in the area of open end.

As the method of removing the bottle from the apparatus, various methods can be utilized. For example, suction of the large vacuum pad 63 is stopped when the partial shrinking of the bag is finished and the bottle temporarily fitted with the bag is dropped to a conveyer 67 through a guide bar 56 for receiving bottle 62 as the guide bar is inclined.

The bottle temporarily fitted with the bag by partial shrinking is transferred to, for example, a shrink tunnel 36 by a conveyer. The heat shrinking film is tightly fitted to the whole face of the bottle by passing through the shrink tunnel 36 of high temperature and thus the packaging bottle is prepared as the final product.

While the invention has been particularly shown and described with reference to preferred embodiments thereof, it will be understood by those skilled in the art that the foregoing and other changes in form and details can be made therein without departing from the spirit and scope of the invention.

To summarized the advantage obtained by the invention, in the preparation of a packaging bag for a bottle from heat shrinking film sheet by the methods of the invention and by using the apparatus of the invention, the scrap piece formed in the process can be discharged continuously and smoothly. Thus, the methods and the apparatus of the invention have advantage of achieving increased efficiency of production by elimination of labor during the operation and by making the processes continuous.

Preparation of packaging bags from heat shrinking film sheet and fitting of the bottles with the bags can be performed uniformly and continuously by means of machines by the methods of the invention and by using the apparatus of the invention. Thus, the methods and the apparatus of the invention have advantage of achieving labor elimination, increase of efficiency of production and decrease of ratio of deficient products.

The method and apparatus of the invention can be applied to packaging of other vessels as well as the packaging of bottles.

What is claimed is:

1. A method of continuous preparation of packaging bags for bottles, comprising:

(A) feeding an end part of a long cylindrical film sheet made of heat shrinking film intermittently by the length of a cutting unit along a cutting and heat sealing table and then fixing the end of the long cylindrical film sheet at a definite position on the cutting and heat sealing table;

(B) cutting off a packaging bag and a scrap piece approximately simultaneously from the end of the long cylindrical film sheet by means of:

(i) a heat sealing blade of arch shape which heat seals a closing end of the packaging bag at a position within the length of the cutting unit from the end of the long cylindrical film sheet and which cuts the long cylindrical film sheet at an outer periphery of the heat sealed closing end; and (ii) a cutting blade of straight shape which is fixed at a position separated from the arch shaped heat sealing blade and which is used for cutting an open end of the packaging bag; and (c) discharging the scrap piece from the cutting and heat sealing table;

wherein the arch shaped heat sealing blade and the straight shaped cutting blade are fixed to the same sliding block and wherein the arch shaped heat sealing blade and the straight shaped cutting blade have respective tips which are fixed in approximately the same plane so that the two tips contact with the cylindrical film sheet at approximately the same time.

2. A method of preparation of packaging bags for bottles as claimed in claim 1, wherein the heat shrinking film comprises polyvinyl chloride.

3. A method of continuous preparation of packaging bags for bottles, comprising:

(A) feeding an end part of a long cylindrical film sheet made of heat shrinking film intermittently by the length of cutting unit along a cutting and heat sealing table and then fixing the end of the long cylindrical film sheet at a definite position on the cutting and heat sealing table;

(B) cutting off a definite length of the cylindrical film sheet and a scrap piece approximately simultaneously from the end of the long cylindrical film sheet by means of:

(i) a cutting blade of arch shape which cuts a closing end of the packaging bag at a position within the length of the cutting unit from the end of the long cylindrical film sheet; and (ii) by means of a cutting blade of straight shape which is fixed at a position separated from a heat sealing blade of arch shape and which is used for cutting an open end of the packaging bag:

(C) discharging the scraps piece from the cutting and heat sealing table; and p1 (D) forming a closed portion of the packaging bag by pressing to the cut cylindrical film sheet the arch-shaped heat sealing blade, which is fixed at an inner side of the arch-shaped cutting blade, approximately simultaneously with the operation of cutting.

4. A method of preparation of packaging bags for bottles as claimed in claim 3, wherein the arch-shaped heat sealing blade and the straight-shaped cutting blade are fixed on a common sliding block, and wherein the arch-shaped heat sealing blade and the straight-shaped cutting blade have respective tips which are fixed in approximately a same plane so that the two tips contact with the cylindrical film sheet at approximately the same time.

5. A method of continuous preparation of packaging bags for bottles as claimed in claim 3, wherein the arch-shaped cutting blade, the arch-shaped heat sealing blade and the straight-shaped cutting blade are fixed on a common sliding block, and wherein the arch-shaped cutting blade and the straight-shaped cutting blade have respective tips which are fixed in approximately a same plane so that the two tips contact with the cylindrical film sheet at approximately the same time.

6. A method of preparation of packaging bags for bottles as claimed in claim 3, wherein the heat shrinking film comprises one of polyethylene terephthalate and polypropylene.

7. A method of preparation of packaging bags for bottles as claimed in claim 1 or 3, wherein the method of discharging the scrap piece from the cutting and heat sealing table comprises:

moving a scrap piece holder toward the long cylindrical film sheet until the scrap piece holder contacts a face of the long cylindrical film sheet at the time that the cylindrical film sheet is cut, the scrap piece holder holding the scrap piece by suction;

lifting the scrap piece holder holding the scrap piece in an upward direction away from the cutting and heat sealing table;

liberating the scrap piece by stopping the suction of the scrap piece holder; and discharging the liberated scrap piece using one of an air stream and a discharging tool.

8. A method of preparation of packaging bags for bottles as claimed in claim 1 of 3, wherein the method of discharging the scrap piece from the cutting and heat sealing table comprises injecting an air stream toward the scrap piece to discharge the scrap piece, said injection of air being synchronized with the cutting of the long cylindrical film sheet.

9. A method of preparation of packaging bags for bottles as claimed in claim 1 or 3, wherein the scrap is moved away from the heat sealed packaging bag in a direction substantially perpendicular to a line of heat sealing by holding the scrap piece by means of a holding device after heat sealing is performed.

10. A method of continuous preparation of packaged bottles, comprising:

(A) automatically preparing a packaging bag by (a) feeding an end part of a long cylindrical film sheet made of heat shrinking film intermittently by the length of a cutting unit along a cutting and heat sealing table and then fixing the end of the long cylindrical film sheet at a definite position on the table;

(b) cutting off a packaging bag and a scrap piece approximately simultaneously from the end of the long cylindrical film sheet by means of:

i) a heat sealing blade of arch shape which heat seals a closing end of the packaging bag at a position within the length of the cutting unit from the end of the long cylindrical film sheet and which cuts the long cylindrical film sheet at an outer periphery of the heat sealed portion, and ii) a cutting blade of straight shape which is fixed at a position separated from the arch-shaped heat sealing blade and which is used for cutting an open end of the packaging bag; and (c) discharging the scrap piece from the cutting and heat sealing table; wherein the arch-shaped heat sealing blade and the straight-shaped cutting blade are fixed on a common sliding block, and wherein the arch-shaped heat sealing blade and the straight-shaped cutting blade have respective tips which are fixed in approximately a same plane so that the two tips contact with the cylindrical film sheet at approximately the same time;

(B) widely opening the open end of the packaging bag and covering a bottle with the packaging bag at the outside of the bottle by inserting the bottle into the open end of the packaging bag; and (C) heating the packaging bag with the bottle fitted therein so as to shrink the packaging bag tightly around the bottle to form a packaged bottle tightly fitted with the packaging bag around the outside of the bottle.

11. A method of continuous preparation of packaged bottles as claimed in claim 10, wherein the heat shrinking film comprises polyvinyl chloride.

12. A method of continuous preparation of packaged bottles, comprising:

(A) automatically preparing a packaging bag by (a) feeding an end part of a long cylindrical film sheet made of heat shrinking film intermittently by the length of cutting unit along a cutting and heat sealing table and then fixing the end part of the long cylindrical film sheet at a definite position on the table;

(b) cutting off a definite length of the cylindrical film sheet for packaging bag and a scrap piece approximately simultaneously from the end of the long cylindrical film sheet by means of i) a cutting blade of arch shape which cuts a closing end of the packaging bag at a position within the length of the cutting unit from the end of the long cylindrical film sheet and ii) a cutting blade of straight shape which is fixed at a position separated from a heat sealing blade of arch shape and which is used for cutting an open end of the packaging bag;

(c) discharging the scrap piece from the cutting and heat sealing table; and forming a closed end of the packaging bag by pressing against the cut cylindrical film sheet, the heat sealing blade of arch shape, which if fixed at an inner side of the arch-shaped cutting blade, approximately simultaneously with the operation of cutting;

(B) widely opening the open end of the packaging bag and covering a bottle with the packaging bag at the outside of the bottle by inserting the bottle into the open end of the packaging bag; and (C) heating the packaging bag with the bottle fitted therein so as to shrink the packaging bag tightly around the bottle to form a packaged bottle tightly fitted with the packaging bag around the outside of the bottle.

13. A method of preparation of packaging bags for bottles as claimed in claim 12, wherein the arch-shaped heat sealing blade and the straight-shaped cutting blade are fixed on a common sliding block, and wherein the arch-shaped heat sealing blade and the straight-shaped cutting blade have respective tips which are fixed in approximately a same plane so that the two tips contact with the cylindrical film sheet at approximately the same time.

14. A method of continuous preparation of packaging bags for bottles as claimed in claim 12, wherein the arch-shaped cutting blade, the arch-shaped heat sealing blade and the straight-shaped cutting blade are fixed on a common sliding block, and wherein the arch-shaped cutting blade and the straight-shaped cutting blade have respective tips which are fixed in approximately a same plane so that the two tips contact with the cylindrical film sheet at approximately the same time.

15. A method of continuous preparation of packaged bottles as claimed in claim 12, wherein the heat shrinking film comprises one of polyethylene terephthalate and polypropylene.

16. A method of continuous preparation packaged bottles as claimed in claim 10 or 12, wherein the cylindrical film sheet comprises a uniaxial oriented film having a coefficient of heat shrinkage parallel to a direction of drawing in the range from 0 to 30% and a coefficient of heat shrinkage perpendicular to the direction of drawing in the range from 20 to 60%.

17. A method of preparation of packaging bags for bottles as claimed in claim 10 or 12, wherein the method of discharging the scrap piece from the cutting and heat sealing table comprises:

moving a scrap piece holder toward the long cylindrical film sheet until the scrap piece holder contacts a face of the long cylindrical film sheet at the time that the cylindrical film sheet is cut, the scrap piece holder holding the scrap piece by suction;

lifting the scrap piece holder holding the scrap piece in an upward direction away from the cutting and heat sealing table;

liberating the scrap piece by stopping the suction of the scrap piece holder; and discharging the liberated scrap piece using one of an air stream and a discharging tool.

18. A method of preparation of packaging bags for bottles as claimed in claim 10 or 12, wherein the method of discharging the scrap piece from the cutting and heat sealing table comprises injecting an air stream toward the scrap piece to discharge the scrap piece, said injection of air being synchronized with the cutting of the long cylindrical film sheet.

19. A method of preparation of packaged bottles, comprising:

(A) melting in an arch shape an end of a cylindrical film sheet made of heat shrinking film to form a closed end of a packaging bag wherein the cylindrical film sheet comprises a uniaxial oriented film having a coefficient of heat shrinkage parallel to a direction of drawing in the range from 0 to 30% and a coefficient of heat shrinkage perpendicular to the direction of drawing in the range from 20 to 60%; widely opening an open end thereof by pulling from the outside of the cylindrical film sheet by the action of vacuum pads attached to the outside of the cylindrical film; separating the vacuum pads from each other; inserting a flapper into the open end of the packaging bag, inserting a bottle which is attached at its bottom to an inserting rod into the open end of the packaging bag such that a top of the packaging bottle is inserted first; and placing the packaging bag over the outside of the bottle; and (B) heating the bottle and the packaging film fitted to the outside of the bottle so as to shrink the packaging bag to fit tightly around the bottle.

20. A method of preparation of packaged bottles as claimed in any one of claims 10, 12, or 19, wherein the step heating the packaging bag with the bottle fitted therein so as to shrink the packaging bag comprises:

temporarily fitting the packaging bag to a face of the bottle by partial shrinking of the packaging bag only in the area of the open end of the packaging bag; and heating the whole bottle fitted temporarily with the packaging bag to fit the packaging bag tightly to the outside of the whole bottle.

21. A method of continuous preparation of packaged bottles as claimed in claim 10 or 12, wherein the scrap is moved away from the heat sealed packaging bag in a direction substantially perpendicular to a line of heat sealing by holding the scrap piece by means of a holding device after heat sealing is performed.

22. An apparatus for continuous preparation of packaging bags for bottles, comprising:

(A) means for intermittently feeding an end part of a long cylindrical film sheet made of heat shrinking film by the length of a cutting unit along a cutting and heat sealing table; and (B) means for cutting and heat sealing comprising:

means for fixing the end part of the long cylindrical film sheet intermittently to the cutting and heat sealing table in sychronization with the intermittent feeding of the long cylindrical film sheet;

a heat sealing blade of arch shape for heat sealing a closing end of the packaging bag at a position within the length of the cutting unit from the end of the long cylindrical film sheet and for cutting the long cylindrical film sheet at the outer periphery of the heat sealed portion;

a cutting blade of straight shape which cuts an open end of the packaging bag;

means for cutting off the packaging bag and a scrap piece approximately simultaneously from the end of the long cylindrical sheet by reciprocal sliding movement of the arch-shaped heat sealing blade and the straight shaped cutting blade in a synchronization with the intermittent feeding of the long cylindrical film sheet to the cutting and heat sealing table; wherein the arch shaped heat sealing blade and the straight shaped cutting blade are fixed to the same sliding block and wherein the arch shaped heat sealing blade and the straight shaped cutting blade have respective tips which are fixed in approximately the same plane so that the two tips contact with the cylindrical film sheet at approximately the same time; and means for discharging the scrape piece formed by the cutting and heat sealing table.

23. An apparatus for continuous preparation of packaged bottles, comprising:

(A) means for intermittently feeding an end part of a long cylindrical film sheet made of heat shrinking film by the length of a cutting unit along a cutting and heat sealing table; and (B) means for cutting and heat sealing comprising:

means for fixing the end part of the long cylindrical film sheet intermittently to the cutting and heat sealing table in synchronization with the intermittent feeding of the long cylindrical film sheet;

a heat sealing blade of arch shape for heat sealing a closing end of the packaging bag at a position within the length of the cutting unit from the end of the long cylindrical film sheet and for cutting the long cylindrical film sheet at the outer periphery of the heat sealed portion;

a cutting blade of straight shape which cuts an open end of the packaging bag;

means for cutting off the packaging bag and a scrap piece approximately simultaneously from the end of the long cylindrical sheet by reciprocal sliding movement of the arch-shaped heat sealing blade and the straight shaped cutting blade in a synchronization with the intermittent feeding of the long cylindrical film sheet to the cutting and heat sealing table; wherein the arch shaped heat sealing blade and the straight shaped cutting blade are fixed to the same sliding block and wherein the arch shaped heat sealing blade and the straight shaped cutting blade have respective tips which are fixed in approximately the same plane so that the two tips contact with the cylindrical film sheet at approximately the same time; and means for discharging the scrap piece formed by the cutting and heat sealing table;

(C) means comprising a device for widely opening the open end of the packaging bag prepared by the means for cutting and heat sealing by holding the outside of the packaging bag by the action of vacuum pads and for inserting a bottle into the open end of the packaging bag in sychronization with the action of widely opening the open end of the packaging bag; and (D) means for heat shrinking the packaging bag so as to fit the packaging bag tightly to the bottle.

24. An apparatus for continuous preparation of packaged bottles as claimed in claim 23, wherein the arch-shaped heat sealing blade and the straight-shaped cutting blade are fixed to a common sliding block and wherein the arch-shaped heat sealing blade and the straight-shaped cutting blade have respective tips which are fixed in approximately a same plane so that the two tips contact with the cylindrical film sheet at approximately the same time.

25. An apparatus for continuous preparation of packaging bags for bottles, comprising:

(A) means for intermittently feeding an end part of a long cylindrical film sheet made of heat shrinking film by the length of a cutting unit along a cutting and heat sealing table;

(B) means for cutting and heat sealing comprising:

means for feeding an end part of the long cylindrical film sheet intermittently to the cutting and heat sealing table in synchronization with the intermittent feeding of the long cylindrical film sheet:

a cutting blade of arch shape which cuts the long cylindrical film sheet at an outer periphery of a closing end of the packaging bag at a position within the length of the cutting unit from the end of the long cylindrical film sheet:

a cutting blade of straight shape which cuts an open end of the packaging bag;

a heat sealing blade of arch shape having approximately the same shape as the arch-shaped cutting blade;

means for cutting off the packaging bag and a scrap piece approximately simultaneously from the end of the long cylindrical film sheet by a reciprocal sliding movement of the arch-shaped heat sealing blade and the straight-shaped cutting blade in synchronization with the intermittent feeding of the long cylindrical film sheet to the curing and heat sealing table;

means for heat sealing the closing end of the packaging bag cut off by the arch-shaped cutting blade by the action of the arch-shaped heat sealing blade; and means for discharging the scrap piece formed by the cutting from the cutting and heat sealing table.

26. An apparatus as claimed in any one of claim 22, 23 or 25, wherein the means for cutting off the packaging bag and a scrap piece approximately simultaneously from the end of the long cylindrical film sheet includes means for moving the scrap piece away from the heat sealed packaging bag in a direction substantially perpendicular to a line of heat sealing by holding the scrap piece by means of a holding device after heat sealing is performed.

27. An apparatus for continuous preparation of packaging bags for bottles, comprising:

(A) means for intermittently feeding an end part of a long cylindrical film sheet made of heat shrinking film by the length of a cutting unit along a cutting and heat sealing table;

(B) means for cutting and heat sealing comprising:

means for feeding an end part of the long cylindrical film sheet intermittently to the cutting and heat sealing table in synchronization with the intermittent feeding of the long cylindrical film sheet;

a cutting blade of arch shape which cuts the long cylindrical film sheet at an outer periphery of a closing end of the packaging bag at a position within the length of the cutting unit from the end of the long cylindrical film sheet;

a cutting blade of straight shape which cuts an open end of the packaging bag;

a heat sealing blade of arch shape having approximately the same shape as the arch-shaped cutting blade;

means for cutting off the packaging bag and a scrap piece approximately simultaneously from the end of the long cylindrical film sheet by a reciprocal sliding movement of the arch-shaped heat sealing blade and the straight-shaped cutting blade in synchronization with the intermittent feeding of the long cylindrical film sheet to the cutting and heat sealing table:

means for heat sealing the closing end of the packaging bag cut off by the arch-shaped cutting blade by the action of the arch-shaped heat sealing blade; and means for discharging the scrap piece formed by the cutting from the cutting and heat sealing table;

(C) means for widely opening the open end of the packaging bag prepared by the means for cutting and heat sealing by holding the outside of the packaging bag by the action of vacuum pads, and means for inserting a bottle into the open end of the packaging bag in synchronization with the action of widely opening the open end of the packaging bag; and (D) means for heat shrinking the packaging bag so as to fit the packaging bag tightly to the bottle.

28. An apparatus for continuous preparation of packaged bottles as claimed in claim 25 or 27, wherein the arch-shaped cutting blade, the arch-shaped heat sealing blade and the straight-shaped cutting blade are fixed to a common sliding block and wherein the arch-shaped cutting blade and the straight-shaped cutting blade have respective tips which are fixed in approximately a same plane so that the two tips contact with the cylindrical film sheet at approximately the same time.

29. An apparatus for preparation of packaged bottles, comprising:

means for widely opening an open end of a packaging bag by holding an outside of the packaging bag by the action of vacuum pads, wherein the packaging bag is prepared by closing an end of a cylindrical film sheet made of heat shrinking material by heat sealing in an arch shape and leaving the other end of the cylindrical film sheet open, and wherein the cylindrical film sheet comprises a uniaxial oriented film having a coefficient of heat shrinkage parallel to a direction of drawing in the range from 0 to 30% and a coefficient of heat shrinkage perpendicular to the direction of drawing in the range from 20 to 60%;

means for inserting a flapper into the open end of the packaging bag in synchronization with the action of making the open end of the packaging bag widely open;

means for inserting a bottle which is fixed at a tip of a rod into the open end of the packaging bag; and means for heat shrinking the packaging bag fitted to the bottle by heating.

30. An apparatus for preparation of packaged bottles as claimed in any one of claim 23, 27 or 29, wherein the means for heat shrinking the packaging bag so as to fit the packaging bag tightly to the bottle comprises a partial heat shrinking device having means for heating only the area of the open end of the packaging bag which is fitted to the outside of the bottle; and a whole heat shrinking device which heats the whole of the bottle and the packaging bag fitted to the bottle.

* * * * *